United States Patent [19]

Francu

[11] Patent Number: 4,913,417

[45] Date of Patent: Apr. 3, 1990

[54] UPPER BODY EXERCISING DEVICE

[76] Inventor: Nicholas J. Francu, 406 Iveys Scenic Dr., Albany, Ga. 31707

[21] Appl. No.: 279,988

[22] Filed: Dec. 5, 1988

[51] Int. Cl.[4] ..... A63B 21/02; A63B 5/00

[52] U.S. Cl. ..... 272/67; 272/140

[58] Field of Search ..... 272/67, 68, 140, 141, 272/142, DIG. 4, 125, 126, 131, 132, 135

[56] References Cited

U.S. PATENT DOCUMENTS

| | | | |
|---|---|---|---|
| 2,920,418 | 1/1960 | Britt . | |
| 2,973,962 | 3/1961 | Griffin . | |
| 3,330,558 | 7/1967 | Simons | 272/68 |
| 3,396,967 | 8/1968 | Brown | 272/67 |
| 3,717,338 | 2/1973 | Hughes . | |
| 3,830,493 | 8/1974 | Miller . | |
| 4,095,789 | 6/1978 | Mueller . | |
| 4,591,151 | 5/1986 | Hensley | 272/68 |
| 4,643,417 | 2/1987 | Nieman . | |

*Primary Examiner*—Stephen R. Crow

*Attorney, Agent, or Firm*—James A. Hinkle

[57] ABSTRACT

A hand exercise device which includes a pair of hand grips which are interconnected by a shaft, which shaft is adapted to be axially received within a hollow bore of one of the hand grips. The shaft has a helix groove bored through the free end thereof which cooperates with a through pin lodged within one hand grip so that when axial pressure is applied to the hand grips, the interaction of the actuating through pin and the helix groove causes the hand grips to rotate in counter directions to one another to thereby compress a resistence spring to exercise the wrists, arms and upper body of the user.

4 Claims, 2 Drawing Sheets

UPPER BODY EXERCISING DEVICE

BACKGROUND OF THE INVENTION

I. Field of the Invention

The present invention relates generally to the field of exercising devices and more particularly, to a device which not only exercises the wrists and arms of the person utilizing it, but also exercises the upper body of the person, in particular, the pectoral muscles.

II. Description of the Prior Art

It is well known that exercise of the arms and upper body is particularly helpful and beneficial to persons engaged in certain athletic pursuits where the arm and upper body muscles are constantly being utilized during the athletic endeavor. It is also desired that such devices be adapted for a wide range of persons utilizing them according to individual physique and particular exercising needs.

There have been numerous patents in the prior art which describe various types of hand-gripping exercise devices and particularly those in which hand grips are rotated relative to one another to compress or twist a spring which offers resistence to the torsional movement.

Typically, the devices of prior art are so constructed that the individual hand grips are designed to rotate relative to one another and when such a movement is performed, the person doing the exercising either compresses or twists a spring within the tubular hand grips thereby causing resistence to the rotational movement of the hand grips. Such exercise will normally only strengthen and condition the arm muscles. To condition other muscles of the upper body, such as the pectoral muscles, there needs to be some provision by which the person exercising may not only rotate the hand grips relative to one another, but move the hand grips axially toward one another against a resistence. The patents typical of the prior art have not addressed such a situation.

SUMMARY OF THE INVENTION

In accordance with the present invention it is contemplated that a torsional twist wrist exercising device will be provided which incorporates manipulative hand grips which not only may be rotated relative to one another against a resistive device, but may also be moved to and fro axially with respect to one another against a resistive means. In this manner, not only will the arm muscles be exercised but the upper body muscles will receive a conditioning workout.

It is therefore an object of the invention to provide a novel and unique hand-gripping exercise device which is suitable for use in the exercising of hands, wrists, arms and upper body muscles.

Another object of the invention is the provision of an exercising device which provides two hand-gripping surfaces which may be rotated relative to one another, and moved axially with respect to one another during the rotational period.

Yet another object of the invention is the provision of an easily manufactured, relatively inexpensive, hand-gripping exercise device which is readily adapted by a wide range of individuals having varying physical characteristics.

Other objects, advantages and capabilities of the invention will become apparent from the following description taken in conjunction with the accompanying drawings showing only a preferred embodiment of the invention.

DESCRIPTION OF THE PREFERRED EMBODIMENT

Figure 1:
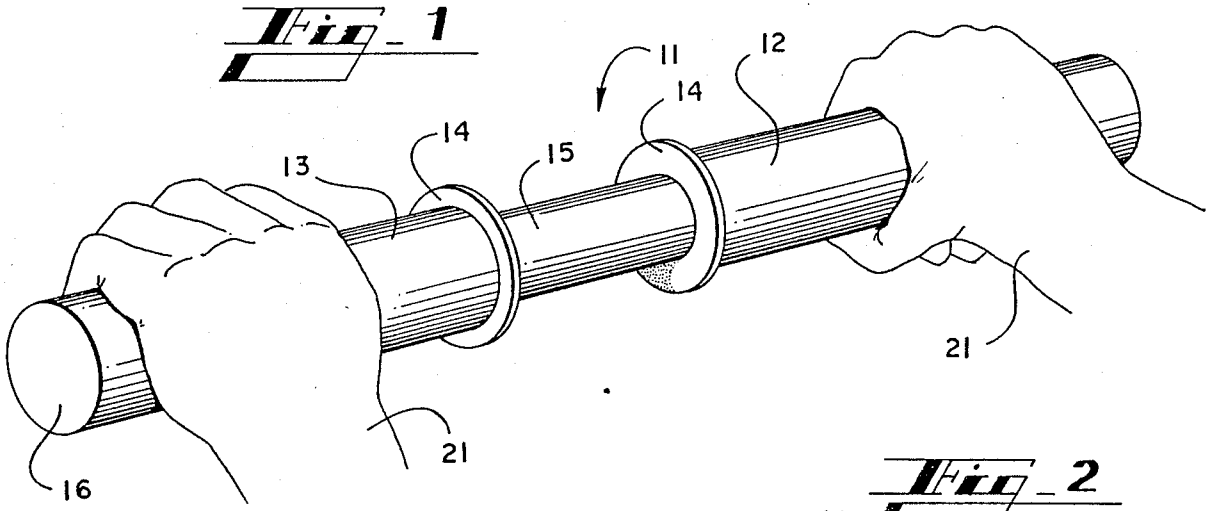
FIG. 1 is a perspective view of the present invention showing its intended mode of use.

Referring to the drawings wherein like numerals designate corresponding parts throughout the several Figures, the hand exercise device of the present invention is generally indicated by the numeral 11. The exercise device comprises a first hand grip 12 and a second hand grip 13 which are operatively interconnected with one another to maintain the hand grips in a contiguous relationship that permits both relative rotation and axially longitudinal movement between the hand grips. It is anticipated that the exterior surface of the hand grips would have a roughened surface thus, allowing the user to obtain a firm grasp of the hand grips.

Inasmuch as there will be axially longitudinal movement of the hand grips in addition to the rotational movement, a hand stop 14 is provided at the interior edge of each hand grip to avoid any occurence of pinching of the hands between the edges of the opposing hand grips should the user's hands slip during exercise.

In order to maintain the hand grips in contiguous relationship, a shaft is provided as part of the first hand grip. The shaft 15 extends outwardly from the first hand grip along the common longitudinal central axis of the first hand grip, with said shaft being affixed at one end to the first hand grip and the other end of the shaft being free. As can be seen in the various Figures, the shaft 15 has a diameter that is somewhat smaller than the diameter of the first hand grip.

The second hand grip 13 is essentially identical to the first hand grip in configuration. Each hand grip will be closed at the free end thereof by an end cap 16 which, due to space limitations in the drawings, is shown only in FIG. 1 for hand grip 13. It should be noted that the end caps 16 need not be a separate part, but may be integrally molded into the hand grips. Each hand grip, however, has essentially the same end cap for end closure. As is more particuarly shown in FIG. 2, hand grip 13 has a hollow interior that forms an axial bore 17. The internal diameter of the axial bore 17 is such that it will accept the shaft 15 for rotational and axial movement therein.

In order to provide a resistence force to the axial and rotational movement of the first hand grip 12 and the shaft 15, a coiled spring 18 is placed within the axial bore 17 of the second hand grip. The spring will be attached at one end thereof against the end cap 16 and the other end of the spring will engage the free end of the shaft 15. It should be apparent that the spring may be varied as to its size and resistive force so that the exercise device may be adapted to persons of varying physical capabilities.

A novel purpose of the present invention is the fact that not only may the hand grips be twisted with respect to one another to provide a torsional twist, but the hand grips, at the time of twisting, will be moved axially with respect to one another to provide upper body exercise to the user. To accomplish this purpose, the exercise device 11 has a built-in, automatic means to effect the rotational movement of the hand grips when the grips are reciprocated axially. Said means includes an actuating through pin 19 which extends through the entire diameter of the second hand grip and projects through a track means, better known as a progressive helix groove 20, which is cut through the entire diameter of the shaft 15. The pin 19 serves not only the purpose of maintaining the two hand grips in a contiguous relationship, but is designed to slide within the helix groove 20 to effect relative rotational movement between the hand grips as the grips are moved toward one another by the person doing the exercising.

Figure 2:
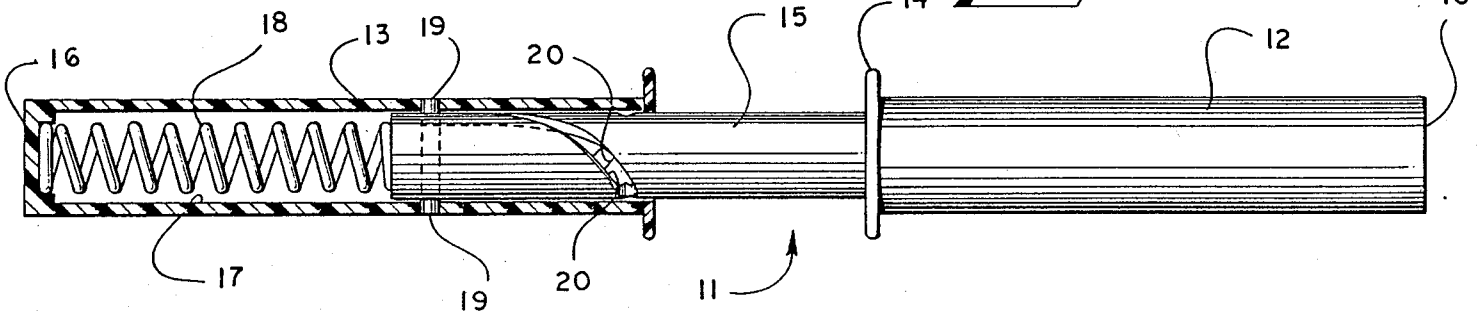
FIG. 2 is an elevation view showing one hand grip portion in a cut-away view.
Figure 3:
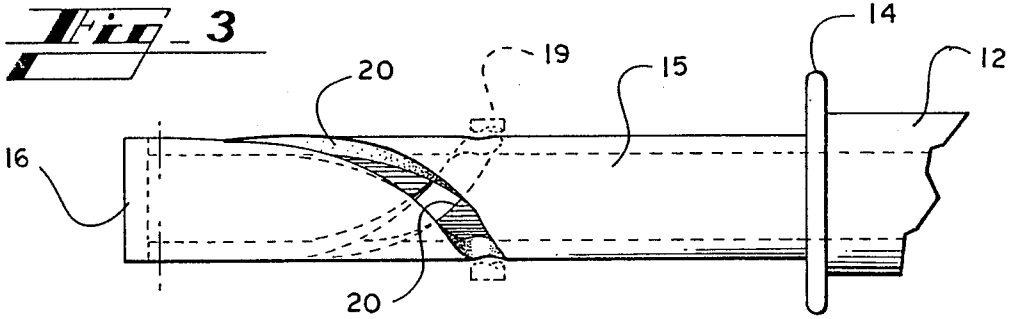
FIG. 3 is a partial elevation view with one hand grip removed.
Figure 4:
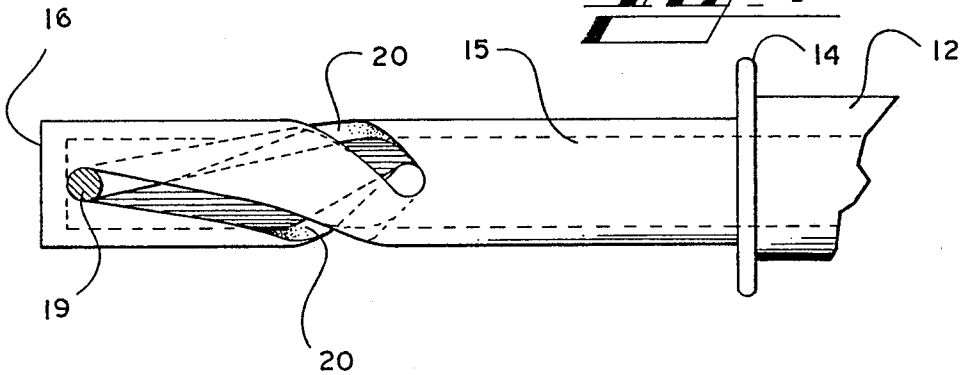
FIG. 4 is a partial top view showing one hand grip removed.

As is evident from FIGS. 1 and 2, when the user's hands 21 are placed on the hand grips 12 and 13 to begin the exercise cycle, it can be seen that by attempting to compress the spring 18 by axially reciprocating the hand grips toward one another, the actuating through pin 19 is forced to follow the progressive helix groove thereby effecting a counter rotation between the respective hand grips. As axial pressure is continuously applied, the hand grips move toward one another and continue the opposite rotations thereby effecting wrist and arm exercise and the desired upper body exercise. Once the hand grips are substantially closed upon one another in such a manner that the hand stops 14 are touching, the user would then release the axial pressure and allow the spring 18 to expand once again, thereby forcing the hand grips apart which will effect the desired exercise in the reverse direction. As is apparent, the user would continue to perform the axial and rotational movements for the desired amount of time necessary to effect the results desired by the user.

Various modifications may be made of the invention without departing from the scope thereof, and it is desired therefore, that only such limitations shall be placed thereon as are imposed by the prior art and which are set forth in the appended claims.

What is claimed is:

1. A torsional twist hand exercise device comprising first and second hand grips disposed in contiguous end-to-end relation on a common longitudinal central axis, said hand grips being operatively interconnected with one another so as to maintain said hand grips in contiguous relationship to permit both relative rotation and axial longitudinal movement between said hand grips, a shaft extending along the common longitudinal central axis from the first hand grip, said shaft being affixed at one end to the first hand grip and being free at the other end thereof;

the second hand grip having a central longitudinally extending axial bore, said bore having a diameter greater than said first hand grip shaft, said axial bore having one closed end and one open end adapted to receive the first hand grip shaft in telescopic engagement, spring means supported within the second hand grip axial bore, said spring means being located in juxtaposition between the closed end of the second hand grip and the free end of the first hand grip shaft, rotational means located adjacent to the free end of said first hand grip shaft to cause relative rotation of the first and second hand grips when said grips are moved longitudinally with respect to one another, said rotational means comprising a track means integral with the first hand grip shaft, said track means extending a predetermined distance longitudinally along said first hand grip shaft, follower means affixed to the second hand grip and being matingly engaged with said track means whereby when the hand grips are axially reciprocated relative to one another, the interaction of the follower means with the track means causes the hand grips to rotate about the common longitudinal central axis in opposing directions, and said follower means comprising a pin extending through the diameter of the second hand grip and through the diameter of the hand grip shaft, and being in juxtaposition with the track means.

2. The exercise device as claimed in claim 1, said track means defining a geometric curve causing the hand grips to rotate relative to one another when said grips are axially reciprocated relative to one another.

3. The exercise device as claimed in claim 2, said geometric curve having the shape of a helix curve.

4. The exercise device as claimed in claim 3, wherein adjacent ends of said hand grips have hand protecting means, said hand protecting means comprising a radially disposed disk mounted on each hand grip perpendicular to the common longitudinal central axis.

* * * * *